US010738983B2

(12) United States Patent
Dinh et al.

(10) Patent No.: US 10,738,983 B2
(45) Date of Patent: Aug. 11, 2020

(54) LUMINAIRE

(71) Applicant: Hubbell Incorporated, Shelton, CT (US)

(72) Inventors: Chau Huyen Tran Dinh, Anaheim, CA (US); Kevin Lu, Fountain Valley, CA (US); Syed Raza, Rancho Palos Verdes, CA (US); Dean DalPonte, Glendale, CA (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 16/263,955

(22) Filed: Jan. 31, 2019

(65) Prior Publication Data

US 2019/0234594 A1 Aug. 1, 2019

Related U.S. Application Data

(60) Provisional application No. 62/625,098, filed on Feb. 1, 2018.

(51) Int. Cl.

| | |
|---|---|
| ***F21V 21/00*** | (2006.01) |
| ***F21V 21/30*** | (2006.01) |
| ***F21V 17/12*** | (2006.01) |

(52) U.S. Cl.

CPC ..... *F21V 21/30* (2013.01); *F21V 17/12* (2013.01)

(58) Field of Classification Search

CPC ..... F21V 29/503; F21V 29/83; F21V 29/773; F21V 7/0025; F21K 9/235; F21K 9/238; F21K 9/66; F21K 9/68; F21K 9/237; F21K 9/233; F21Y 2115/10; F21Y 2105/18; F21Y 2103/33

USPC ..... 362/371

See application file for complete search history.

(56) References Cited

U.S. PATENT DOCUMENTS

| | | | | |
|---|---|---|---|---|
| D263,021 | S * | 2/1982 | Siegfried | D11/5 |
| 4,875,653 | A * | 10/1989 | Connolly | A47G 7/047 248/332 |
| D464,559 | S * | 10/2002 | Bjorklund | D8/356 |
| 6,629,675 | B1 * | 10/2003 | Bjorklund | H02G 3/30 248/49 |
| 7,686,483 | B1 * | 3/2010 | Aubrey | F21V 13/04 362/147 |

* cited by examiner

*Primary Examiner* — Ali Alavi

(74) *Attorney, Agent, or Firm* — Michael Best & Friedrich, LLP

(57) ABSTRACT

A luminaire includes a support, a housing, and an adjustment assembly. The housing has at least one light emitter and is pivotably coupled to the support. The adjustment assembly has a pivoting member and a fastening member. The pivoting member is supported for movement relative to the bracket. The fastening member is coupled to the pivoting member and the housing.

19 Claims, 6 Drawing Sheets

LUMINAIRE

CROSS-REFERENCE TO RELATED APPLICATION

This application claims the benefit of prior-filed, Provisional Patent Application No. 62/625,098, filed Feb. 1, 2018, the entire contents of which are incorporated by reference herein.

BACKGROUND

The present disclosure relates to a luminaire, and more specifically to an adjustment assembly for changing the position and/or orientation of the luminaire.

SUMMARY

In one aspect, a luminaire includes a support, a housing, and an adjustment assembly. The housing having at least one light emitter and being pivotably coupled to the support. The adjustment assembly having a pivoting member and a fastening member. The pivoting member supported for movement relative to the support. The fastening member coupled to the pivoting member and the housing.

In another aspect, an adjustment assembly for a luminaire. The luminaire includes a housing pivotably coupled to the support. The housing having a light emitter inside a sealed section. The adjustment assembly including a bracket, a pivoting member, and a fastening member. The pivoting member having an aperture and being retained by the first bracket supported for rotational movement. A fastening member coupled to the housing and being inserted through the support, the pivoting member, and the bracket.

In another aspect, a method for adjusting a luminaire. The luminaire includes a support and a housing pivotably coupled to the support. The housing having at least on light emitter. The method includes, rotating a fastening member in a first direction, and pivoting a pivoting member and a fastening member. Wherein, pivoting the pivoting member and the fastening member pivots the housing in the same direction as the pivoting member and the fastening member relative to the support.

Other aspects of the disclosure will become apparent by consideration of the detailed description and accompanying drawings.

DETAILED DESCRIPTION

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

In general, the present disclosure relates to an adjustment assembly for a luminaire. The adjustment assembly allows at least a portion of the luminaire to pivot and change the orientation of a light emitter.

Figure 1:
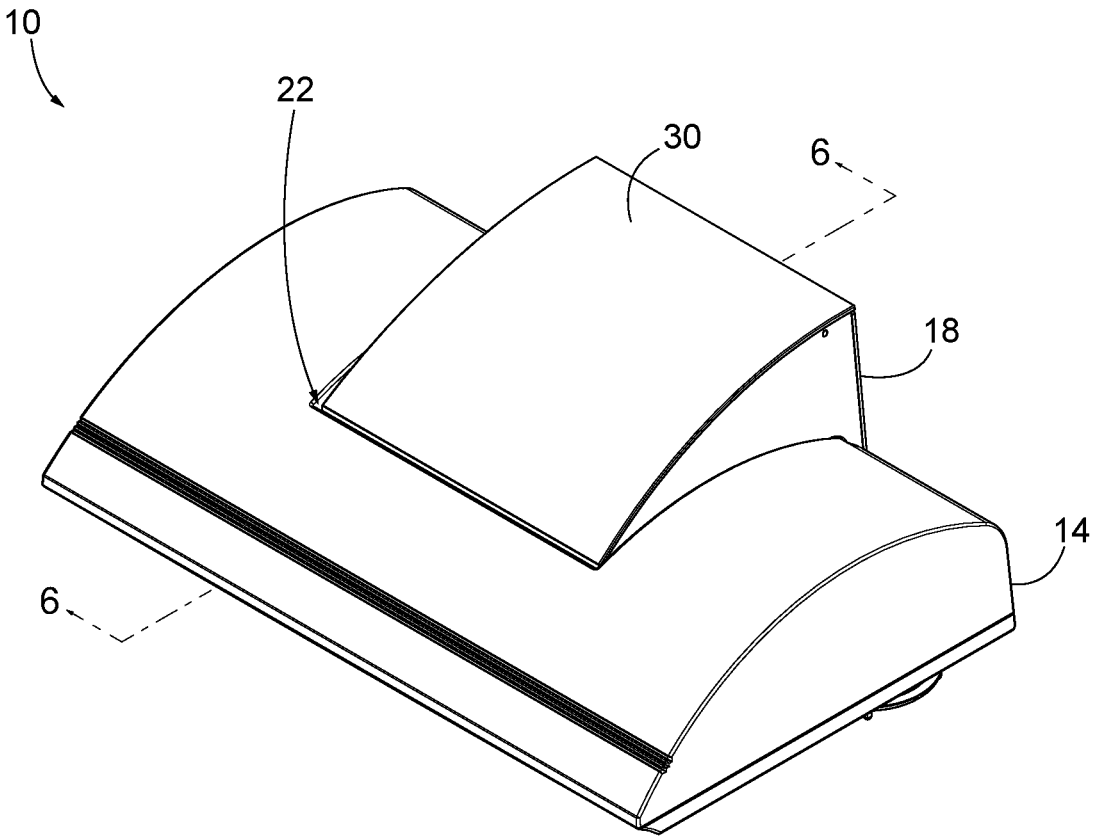
FIG. 1 is a perspective view of a luminaire.
Figure 6:
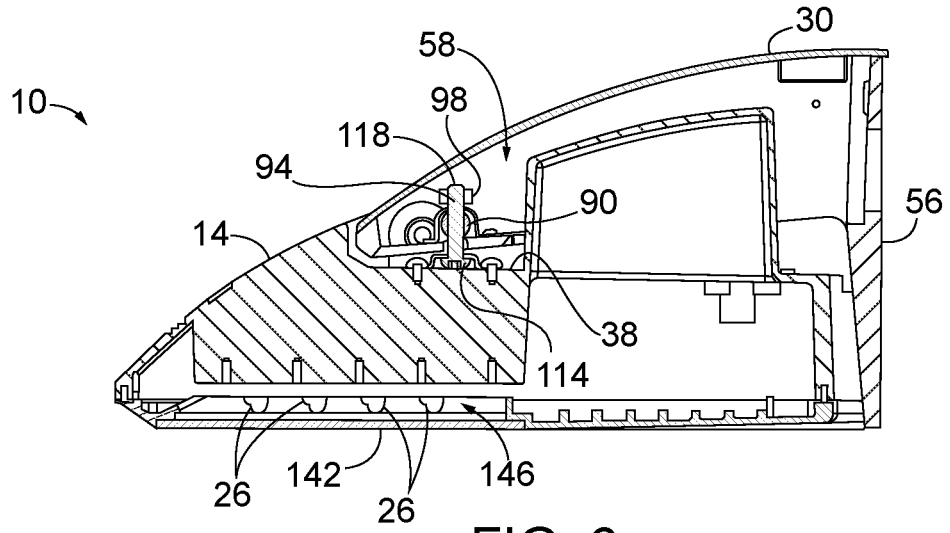
FIG. 6 is a cross-sectional view of the luminaire of FIG. 1 in a first position viewed along section 6-6.

As shown in FIG. 1, a luminaire 10 includes a housing 14 and a support 18. In the illustrated embodiment, the housing 14 and the support 18 have rounded profiles. In other embodiments, the housing 14 and/or the support 18 may have different shaped profiles. The housing 14 includes a cutout 22 and light emitters 26 (FIG. 6). The cutout 22 is substantially rectangular in shape. The support 18 is positioned in the cutout 22 and is pivotably coupled to and supports the housing 14. In the illustrated embodiment, a cap 30 is coupled to the support 18 and includes a curved surface.

Figure 2:
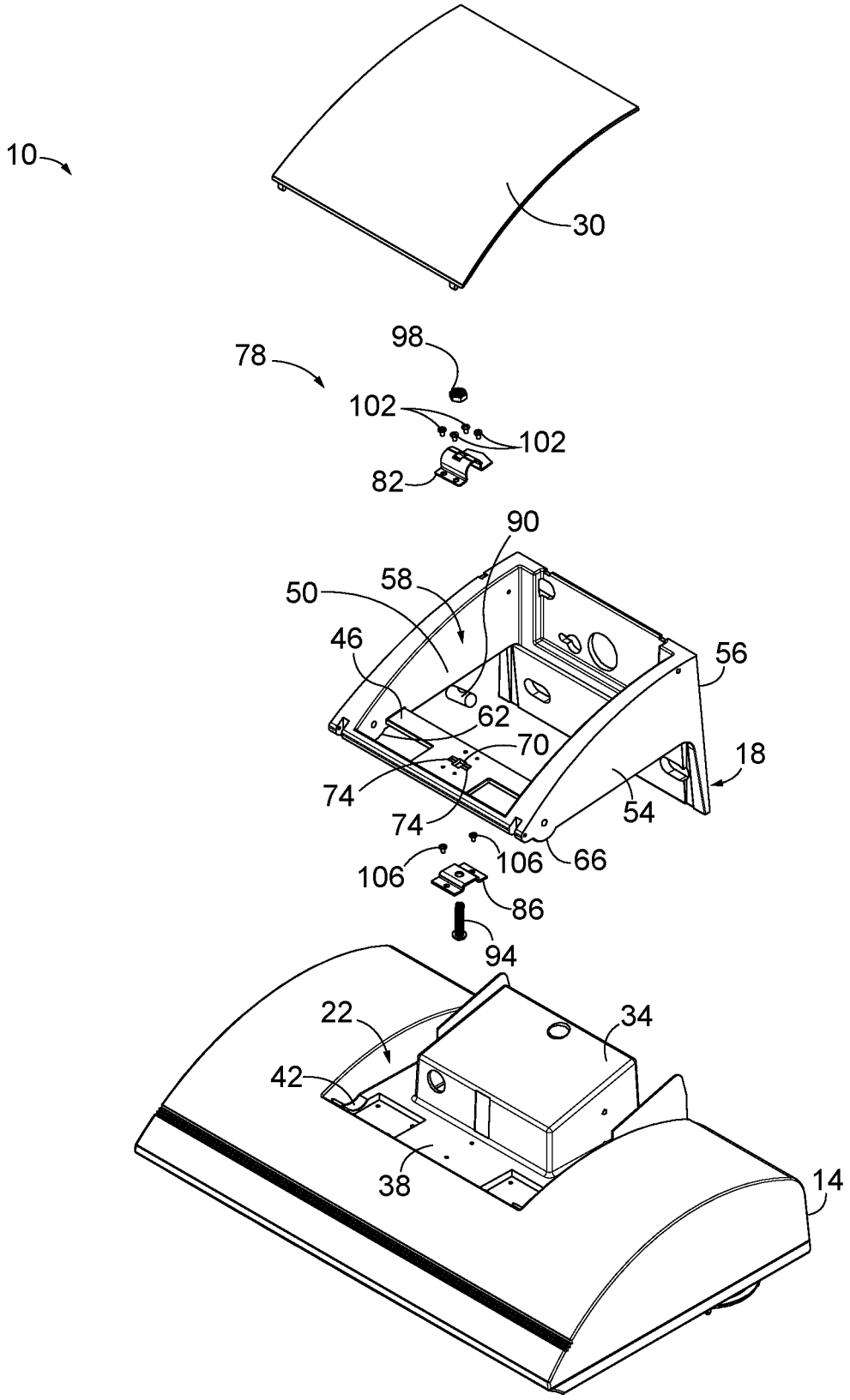
FIG. 2 is an exploded view of the luminaire of FIG. 1.

As shown in FIG. 2, the housing 14 includes a control housing 34 and a surface or housing frame 38. The control housing 34 can support or enclose drivers (not shown) which control light emitters 26 (FIG. 6). In the illustrated embodiment, the housing frame 38 is a generally flat surface and includes with a first concave portion 42 and a second concave portion (not shown). The first concave portion 42 and the second concave portion can be the same size and disposed at opposite sides of the cutout 22.

The support 18 includes a support surface or support frame 46. In the illustrated embodiment, the support frame 46 is generally flat and is positioned at an edge of the support 18 extending between a first side 50 and a second side 54 of the support 18. The support frame 46, the first side 50, the second side 54, and a rear end 56 of the support 18 define a cavity 58. The cavity 58 receives the control housing 34 when the housing 14 is coupled to the support 18. The support frame 46 includes a first convex portion 62 and a second convex portion 66. The first convex portion 62 is positioned in the first concave portion 42 and the second convex portion 66 is positioned in the second concave portion. The support frame 46 is positioned above the housing frame 38 when the housing 14 is coupled to the support 18.

Figure 3:
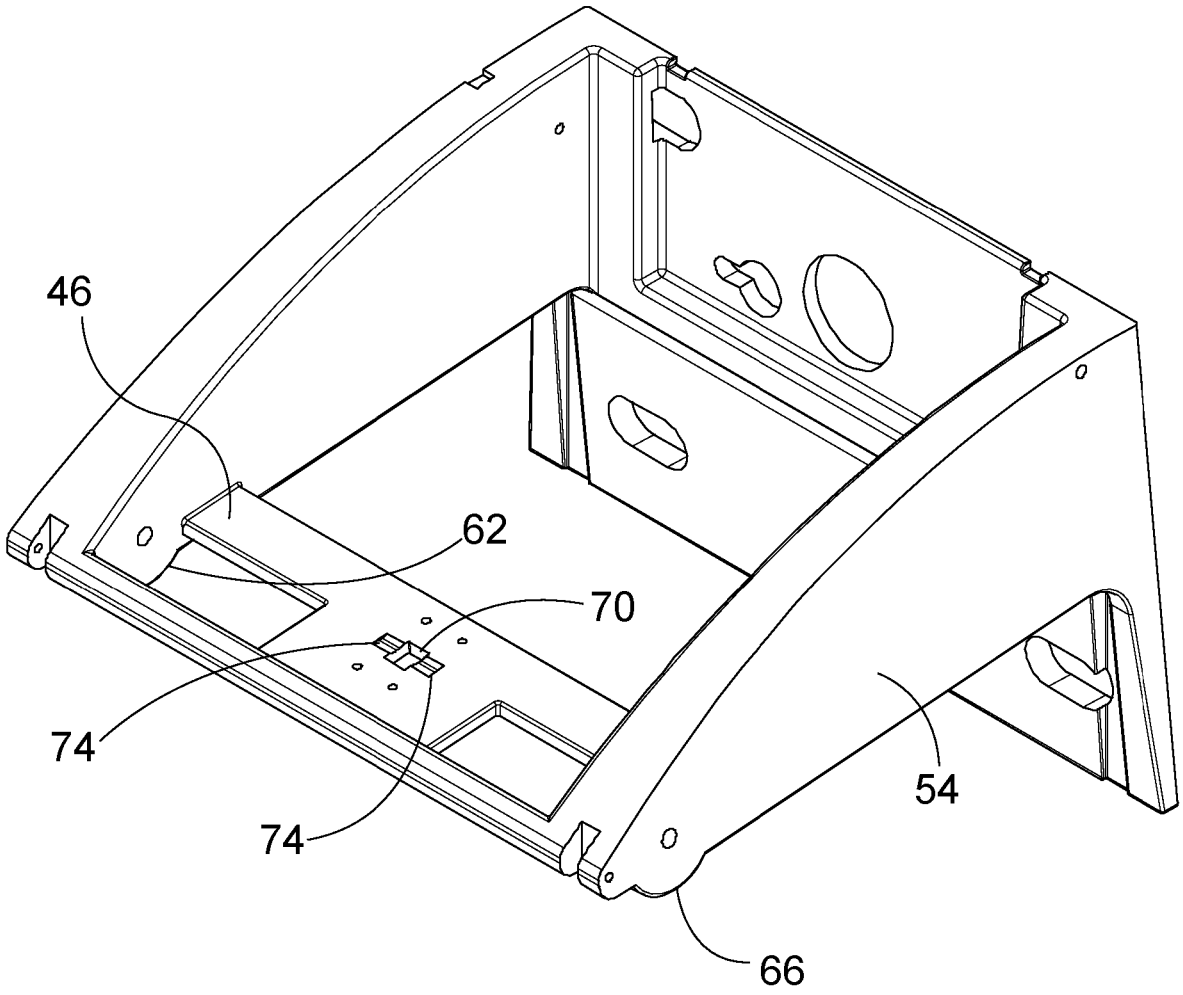
FIG. 3 is an enlarged view of a frame of the luminaire of FIG. 2.

As shown in FIG. 3, the support frame 46 also includes an aperture 70 and arcuate portions 74. The aperture 70 extends through the support frame 46, and the arcuate portions 74 are disposed on either side of the aperture 70. In the illustrated embodiment, the aperture 70 is rectangular in shape, although in other embodiments, the aperture may be another shape. Additionally, each arcuate portion 74 extends along a portion of a width of the aperture 70.

Figure 4:
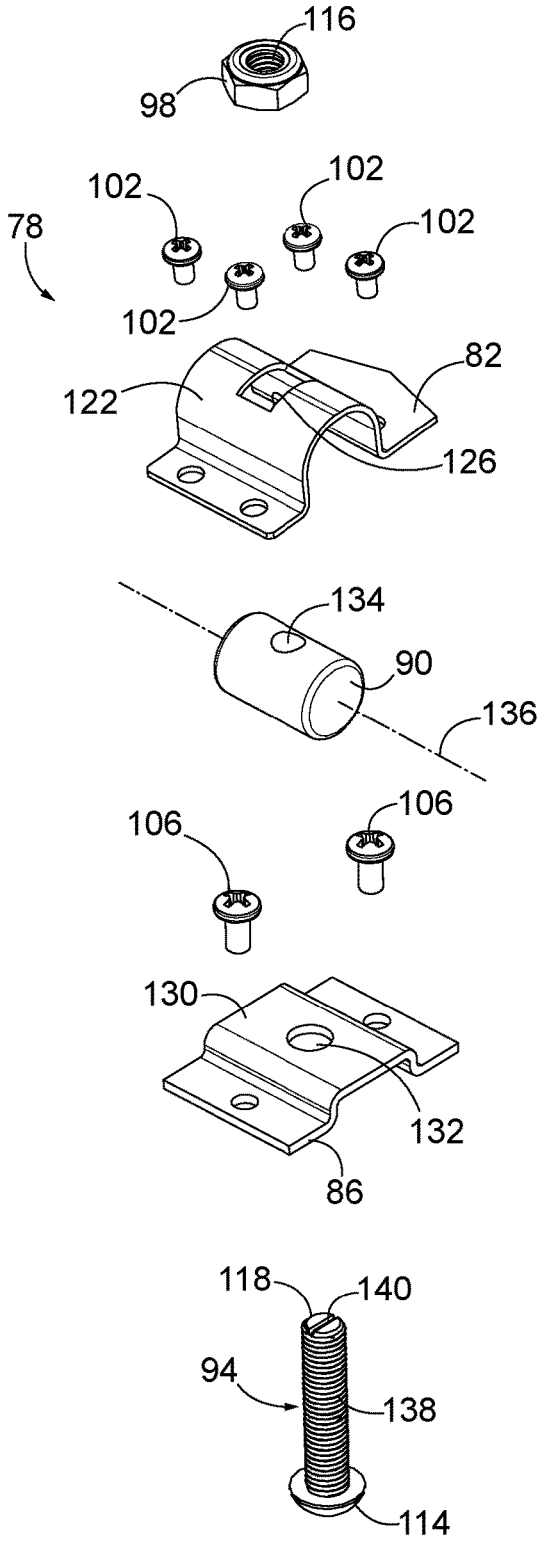
FIG. 4 is a fully exploded view of an adjustment assembly.

An adjustment assembly 78 is positioned between the housing 14 and the support 18. The adjustment assembly 78 includes a first bracket 82, a second bracket 86, a pivoting member 90, a fastening member 94, and a locking member 98. The first bracket 82 is positioned over the pivoting member 90 and is coupled to the support frame 46 by fastening members 102. In the illustrated embodiment, the pivoting member 90 is cylindrical in shape and rests in the arcuate portion 74. The second bracket 86 is coupled to the housing frame 38 by fasteners 106 and is aligned with the first bracket 82. As shown in FIG. 4, in the illustrated embodiment, the fastening member 94 is a threaded bolt with a head 114 and an end 118 disposed opposite the head 114, and the locking member 98 is a nut with a threaded portion 116.

In addition, the first bracket 82 has a curved portion 122 that forms a rounded profile and a slot 126. The rounded profile is similar in shape to the pivoting member 90 so that the pivoting member 90 may be secured by the first bracket 82 against translational movement relative to the support 18 (FIG. 2). In the illustrated embodiment, the slot 126 extends along a portion of the curved surface 122 and is rectangular in shape. In other embodiments, the slot 126 may be another shape.

In the illustrated embodiment, the second bracket 86 has a substantially flat center surface 130 that is offset from a pair of side portions; in other embodiments the second bracket 86 may have a different shape. The center surface 130 includes an aperture 132 which extends through the center surface 130.

An opening 134 extends through the pivoting member 90 orthogonal to a pivoting axis 136. In the illustrated embodiment, the opening 134 is centered between a pair of ends of the pivoting member 90. Referring to FIG. 4, the bolt 94 includes a threaded portion 138 extending between the head 114 and the end 118. The threaded portion of the nut 98 is configured to couple to the threaded portion 138 of the bolt 94. The end of the bolt 94 includes a slot 140 that extends across the end 118. In other embodiments, the fastening member 94 may have a feature other than a straight slot (e.g., a hex-shaped end 141—FIG. 9).

Figure 5:
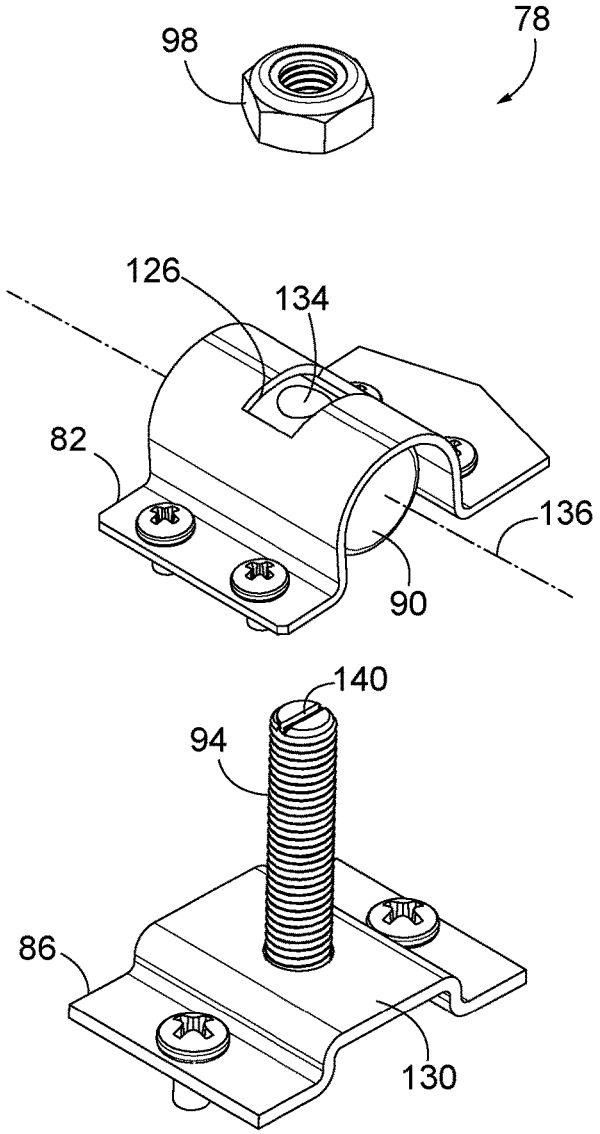
FIG. 5 is a partial exploded view of the adjustment assembly of FIG. 3.

As shown in FIG. 5, the screw 94 is inserted through the second bracket 86 so that the fastener head 114 (FIG. 4) abuts a surface opposite the surface 130. The head 114 and the second bracket 86 are positioned proximate the housing frame 38 of the housing 14 (FIG. 2). The pivoting member 90 is secured between the first bracket 82 and the support frame 46 (FIG. 2) so that the opening 134 of the pivoting member 90 and the slot 126 of the first bracket 82 are aligned with the aperture 70 (FIG. 2). The end 118 of the screw 94 extends through the aperture 70 of the frame 48 and the opening 134 of the pivoting member 90. The threaded portion 138 of the screw 94 engages an interior of the opening 134 to couple the fastening member 94 to the pivoting member 90. Since the pivoting member 90 is coupled to the support frame 46 via the first bracket 82 and the screw is coupled to the housing frame 38 via the second bracket, coupling the screw 94 to the pivoting member 90 couples the housing 14 to the support 18. The fastening member 94 extends through the slot 126 and the nut 98 is then positioned over the end 118 of the screw 94 and threadably connected to the screw 94. A width of the slot 126 is substantially the same as the diameter of the screw 94, permitting the screw 94 to rotate but not translate relative to the first bracket 82. As viewed from FIG. 5, rotating the nut 98 in a clockwise direction moves the nut 98 toward the first bracket 82 and rotating the nut 98 in the counter-clockwise direction moves the nut 98 toward the end 118 of the screw 94.

As shown in FIG. 6, the light emitters 26 supported on the housing of the luminaire 10 are in a first position (e.g., a horizontal position oriented orthogonal to the rear or support end 56). Each light emitter 26 may include a light emitting diode (LED). A lens 142 is positioned over the light emitters 26 to enclose a compartment 146. The enclosed compartment 146 isolates light emitters 26 from the cavity 58 and from an external environment.

Figure 7:
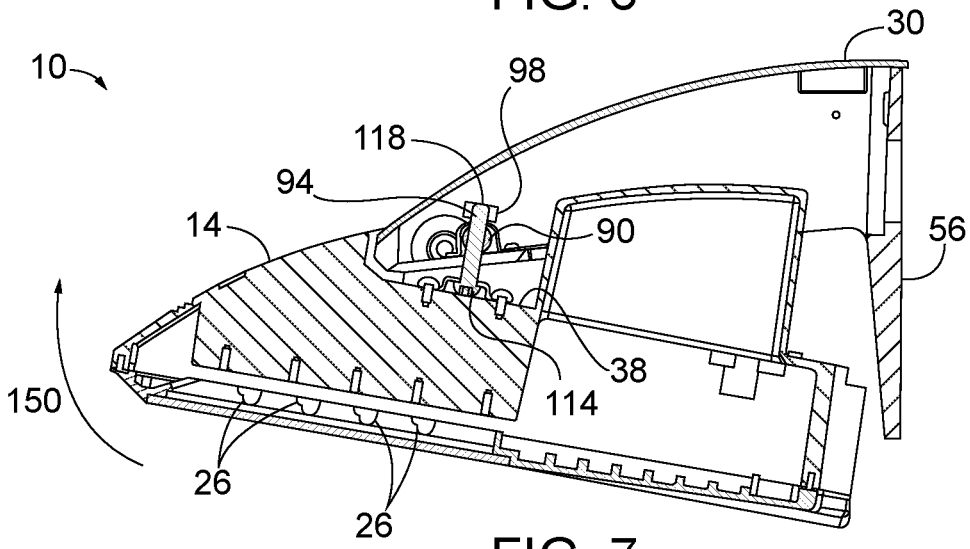
FIG. 7 is a cross-sectional view of the luminaire of FIG. 1 in a second position viewed along section 6-6.

As shown in FIG. 7, the housing 14 can be pivoted in a first direction 150 to a second position. In the illustrated embodiment, the housing 14 may pivot between 0 and 10 degrees about the pivoting axis 136 (FIG. 3) in the first direction 150. In other embodiments, the housing may pivot within a different angular range. In the second position, the light emitters 26 are oriented at an oblique angle relative to the rear end 56 so that light emitted from the light emitters 26 is directed away from the rear end 56. Stated another way, the housing 14 forms a positive angle relative to the plane of the support end surface 56. Additionally, the nut 98 is positioned closer to the end 118 of the screw 94 than in the first position (FIG. 6).

Figure 8:
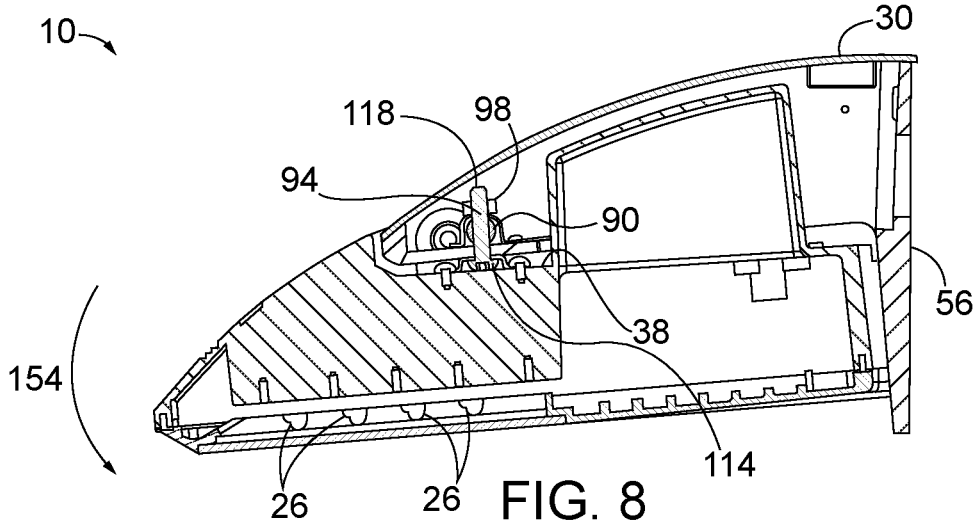
FIG. 8 is a cross-sectional view of the luminaire of FIG. 1 in a third position viewed along section 6-6.

As shown in FIG. 8, the housing 14 is pivoted in a second direction 154 to reach the third position. In the illustrated embodiment, the housing 14 may pivot between 0 and 5 degrees about the pivoting axis 136 (FIG. 3) in the second direction 154. In other embodiments, the housing may pivot within a different angular range. In the third position, the light emitter 26 is oriented at an oblique angle relative to the rear end 56 so that light emitted from the light emitter 26 is directed at least partially toward the support end 56. Stated another way, the housing 14 forms a negative angle relative to the plane of the support end surface 56. Additionally, the nut 98 is positioned closer to the head 114 of the screw 94 than in the first position (FIG. 6).

The luminaire 10 is configured to be mounted on a wall (not shown). The rear end 56 of the support 18 is configured to couple to the wall so that the housing 14 extends away from the wall. The housing is oriented so that the light emitter 26 inside of the housing 14 is positioned in either an upwards or downwards direction. The adjustment assembly 78 positions the housing 14 in either the first, second or third positions. In the illustrated embodiment, the cap 30 selectively covers the cavity 58. To access the adjustment assembly, the cap 30 is moved (e.g., lifted) in order to expose the cavity 58. In each position (i.e., any of the first, second, or third positions), a surface of the nut 98 is adjacent the first bracket 82 to secure the screw 94 against moving.

Figure 9:
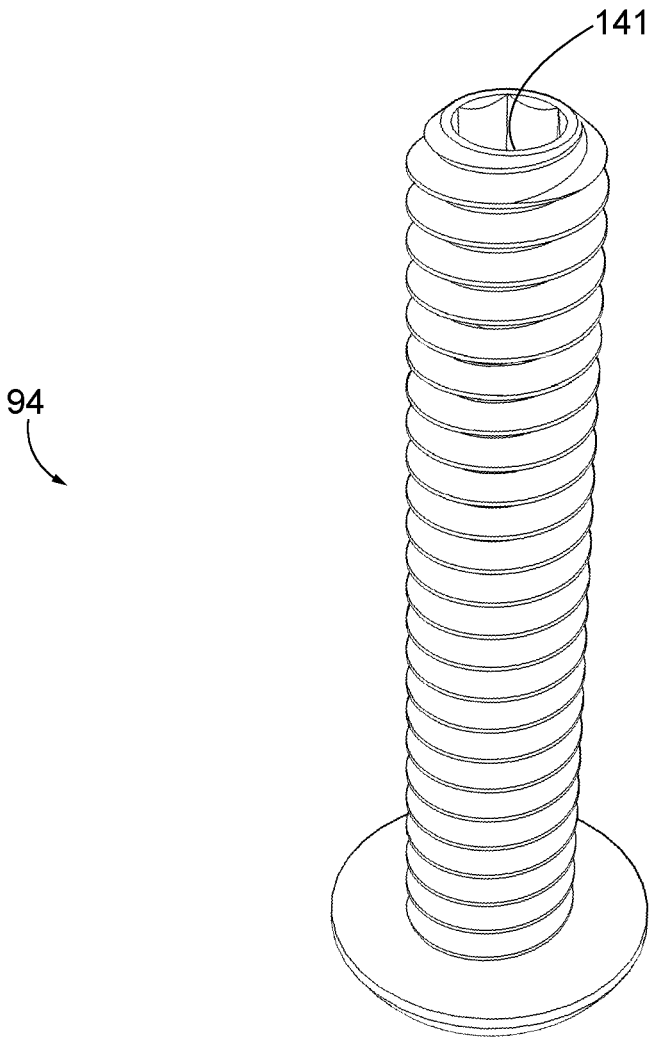
FIG. 9 is a perspective view of a fastening member according to another embodiment.

The nut 98 is loosened to allow pivoting to occur. A tool (e.g., a screwdriver—not shown) is positioned in the slot 140 (FIG. 5). A user applies a torque to the tool, which rotates the screw 94. The user can apply a torque in either a clockwise or counter-clockwise direction. In the embodiment of FIG. 9, a tool (e.g., a hex key or Allen wrench—not shown) may be positioned within the hex-shaped end 141 of the bolt 94, and the user may apply a torque to the tool in order to rotate the bolt 94.

The screw 94 is secured to the second bracket 86 such that there is substantially no clearance between the head 114 and the housing frame 38. Additionally, the aperture 132 of the second bracket 86 has a diameter substantially equivalent to the diameter of the screw 94, permitting the screw 94 to rotate but not translate relative to the second bracket 86. The housing frame 38 and the second bracket 86 prevent the screw 94 from moving relative to the housing 14. Instead, rotation of the screw 94 supplies a force to the housing frame 38 of the housing 14. When the screw 94 rotates to thread the nut 98 toward the head 114 of the screw 94 (e.g., clockwise), the head 114 provides a compressive force to the second bracket 86 which provides a tensile force to the housing frame 38 and causes the housing 14 to pivot to the second position. And when the screw 94 rotates to unthread the nut 98 toward the end 118 of the screw 94 (e.g., counter-clockwise), the head 114 provides a compressive force to the housing frame 38 and causes the housing 14 to pivot to the third position.

The rotation of the screw 94 causes the pivoting member 90 to pivot about the arcuate portion 74 (FIG. 2). Since the screw 94 is coupled to the pivoting member 90, the screw 94 pivots with the pivoting member 90. The threaded portion 138 of the screw 94 threadably engages the opening 134 of the pivoting member 90 and locks the screw 94 in place when the screw 94 is not rotating. This retains the housing 14 in a desired position when the screw 94 is not rotating. The slot 126 in the first bracket 82 and the aperture 70 in the frame 48 each provide an area for the screw 94 to pivot. Pivoting the housing 14 to the second position (FIG. 7) causes the aperture 132 of the second bracket 86 to move further away from the aperture 70 of the frame 48 than in the first position (FIG. 6). Pivoting the housing 14 to the second position also moves the screw 94 in the same direction as the housing frame 38 and provides a shorter length of the screw 94 that extends above the first bracket 82 in the second position than in the first position. Pivoting the housing 14 to the third position (FIG. 8) causes the aperture 132 of the second bracket 86 to move closer to the aperture 70 of the frame 48 than in the first position. Pivoting the housing 14 to the third position also moves the screw 94 in the same direction as the housing frame 38 and provides a longer length of the screw 94 that extends above the first bracket 82 than in the first position.

Once the housing 14 is pivoted to a desired position, the nut 98 is rotated to move the nut 98 to engage the first bracket 82 and secure the screw 94 inside the opening 134 of the pivoting member 90. This prevents the screw 94 from rotating, and retains the housing 14 in the desired position. The cap 30 is then moved to its original position to again cover the cavity 58 and the adjustment assembly 78.

The embodiment(s) described above and illustrated in the figures are presented by way of example only and are not intended as a limitation upon the concepts and principles of the present disclosure. As such, it will be appreciated that variations and modifications to the elements and their configuration and/or arrangement exist within the spirit and scope of one or more independent aspects as described.

What is claimed is:

1. A luminaire comprising:

a support;

a housing including at least one light emitter, the housing pivotably coupled to the support;

an adjustment assembly for moving the housing relative to the support, the adjustment assembly including, a pivoting member supported for movement relative to the support;

a fastening member coupled to the pivoting member and the housing; and a nut coupled to the fastening member, loosening the nut allowing the housing to pivot relative to the support and tightening the nut secures the housing against pivoting.

2. The luminaire of claim 1, wherein the at least one light emitter is housed in an enclosed compartment and separated from the adjustment assembly.

3. The luminaire of claim 1, further comprising a cap coupled to the support and selectively covering the adjustment assembly.

4. The luminaire of claim 1, wherein the adjustment assembly further includes a bracket coupled to the support, the pivoting member supported for movement relative to the bracket.

5. The luminaire of claim 4, wherein the bracket limits translational movement of the pivoting member with respect to the support but allows rotational movement of the pivoting member with respect to the support.

6. The luminaire of claim 4, wherein the bracket is a first bracket, coupled to a support surface and wherein the adjustment assembly further includes a second bracket coupled to a housing surface, the fastening member inserted through the first bracket and the second bracket.

7. The luminaire of claim 1, wherein one of the support and the housing includes a concave portion engaging, and configured to pivot about, a convex portion positioned on the other of the support and the housing.

8. An adjustment assembly for a luminaire, the luminaire including a housing pivotably coupled to a support, the housing having a light emitter inside a sealed section, the adjustment assembly comprising:

a bracket, a pivoting member having an aperture and being retained by the first bracket and supported for pivoting movement about a first axis; and a fastening member coupled to the housing and inserted through the support, the pivoting member, and the bracket, the fastening member pivotable with the pivoting member about the first axis, the fastening member rotatable about a second axis orthogonal with respect to the first axis.

9. The adjustment assembly of claim 8, wherein the bracket is a first bracket and includes a gap configured to allow the fastening member to pivot within the gap, and the adjustment assembly further comprising a second bracket coupled to the housing including a bracket aperture configured to limit the fastening member from pivoting within the bracket aperture.

10. The adjustment assembly of claim 8, wherein the fastening member is threadably coupled to the pivoting member.

11. The adjustment assembly of claim 8, further comprising a nut coupled to the fastening member, wherein tightening the nut limits the fastening member from rotating, and loosening the nut permits the fastening member to rotate relative to the pivoting member.

12. The adjustment assembly of claim 8, wherein rotating the fastening member in a clockwise direction pivots the housing in a first direction with respect to the support, and rotating the fastening member in a counter-clockwise direction pivots the housing in a second direction with respect to the support.

13. The adjustment assembly of claim 8, wherein the bracket limits translational movement of the pivoting member with respect to the support but allows rotational movement of the pivoting member with respect to the support.

14. A method for adjusting a luminaire, the luminaire including a support and a housing pivotably coupled to the support, the housing having at least one light emitter, the method comprising:

rotating a fastening member about an axis of rotation; and pivoting a pivoting member and the fastening member about a pivot axis oriented orthogonal to the axis of rotation, thereby pivoting the housing in the same direction as the pivoting member and the fastening member relative to the support.

15. The method of claim 14, further comprising:

positioning a tool within a channel on an end of the fastening member; and transferring a torque from the tool to the fastening member in order to rotate the fastening member.

16. The method of claim 14, further comprising locking the fastening member against return.

17. The method of claim 14, further comprising removing a cap coupled to the support to provide access to the fastening member.

18. The method of claim 14, wherein pivoting the pivoting member includes moving the housing in an angular range of 0 to 10 degrees in first direction about the pivot axis.

19. The method of claim 18, wherein pivoting the pivoting member includes moving the housing in an angular range of 0 to 5 degrees in a second direction about the pivot axis, opposite the first direction.

* * * * *